US011208785B2

(12) United States Patent
Clemons et al.

(10) Patent No.: US 11,208,785 B2
(45) Date of Patent: Dec. 28, 2021

(54) TOOL COUPLING ARRANGEMENT HAVING ZERO OFFSET

(71) Applicant: Caterpillar Inc., Deerfield, IL (US)

(72) Inventors: John K. Clemons, Wamego, KS (US); Aaron D. Kovar, Topeka, KS (US)

(73) Assignee: Caterpillar Inc., Peoria, IL (US)

( * ) Notice: Subject to any disclaimer, the term of this patent is extended or adjusted under 35 U.S.C. 154(b) by 215 days.

(21) Appl. No.: 16/217,153

(22) Filed: Dec. 12, 2018

(65) Prior Publication Data

US 2020/0190765 A1 Jun. 18, 2020

(51) Int. Cl.
*E02F 3/36* (2006.01)

(52) U.S. Cl.
CPC ..... *E02F 3/364* (2013.01); *E02F 3/3663* (2013.01)

(58) Field of Classification Search
CPC ..... E02F 3/364; E02F 3/3609; E02F 3/3618; E02F 3/3622; E02F 3/3627; E02F 3/3631; E02F 3/3645; E02F 3/365; E02F 3/3659; E02F 3/3663
See application file for complete search history.

(56) References Cited

U.S. PATENT DOCUMENTS 4,187,050 A * 2/1980 Barbee ..... E02F 3/3622 414/723
4,643,631 A 2/1987 Maurer et al.
5,024,010 A * 6/1991 Hulden ..... E02F 3/3622 37/417
5,431,528 A * 7/1995 Jenkins ..... E02F 3/3631 172/275
5,597,283 A * 1/1997 Jones ..... E02F 3/3627 37/468
5,634,736 A * 6/1997 Brown ..... E02F 3/3627 403/319
5,890,871 A * 4/1999 Woerman ..... E02F 3/3627 414/723
5,915,837 A * 6/1999 Brown ..... E02F 3/364 37/468
5,966,850 A 10/1999 Horton
6,058,633 A * 5/2000 Barden ..... E02F 3/3618 37/468
6,123,501 A * 9/2000 Pisco ..... E02F 3/3672 37/468
6,241,455 B1 6/2001 Schupback et al.
6,305,106 B1 * 10/2001 McLellan ..... E02F 3/3627 37/468
6,332,732 B1 * 12/2001 Mantovani ..... E02F 3/3627 172/275

(Continued)

FOREIGN PATENT DOCUMENTS

EP 674053 B1 3/1995

*Primary Examiner* — Jamie L McGowan
(74) *Attorney, Agent, or Firm* — von Briesen & Roper, s.c.

(57) ABSTRACT

A tool coupler for coupling a tool to an end of a machine link. The tool coupler having a coupler frame, a hook configured to receive a first pin of the tool and configured to attach to the end of the machine link such that the tool coupler, a wedge slidingly received within the coupler frame, and an actuator connected to the wedge to move the wedge away from the hook to bias a second pin of the tool against the coupler frame. The tool coupler mounts the tool to the machine link such that the tool and the tool coupler pivots about the same axis.

20 Claims, 9 Drawing Sheets

(56) References Cited

U.S. PATENT DOCUMENTS

| | | | | |
|---|---|---|---|---|
| 6,438,875 | B1 * | 8/2002 | Kimble | E02F 3/3663 37/468 |
| 6,487,800 | B1 * | 12/2002 | Evans | E02F 3/3627 37/468 |
| 6,499,904 | B2 * | 12/2002 | Nye | E02F 3/364 37/468 |
| 6,658,770 | B2 * | 12/2003 | Heiple | E02F 3/3636 37/468 |
| 6,709,224 | B2 | 3/2004 | Heiple | |
| 7,223,061 | B2 | 5/2007 | Gelb | |
| 7,648,305 | B2 | 1/2010 | Beales | |
| 7,654,019 | B2 * | 2/2010 | Yeager | E02F 3/3663 37/468 |
| 8,602,676 | B2 * | 12/2013 | Stollery | E02F 3/3631 403/322.1 |
| 8,684,623 | B2 | 4/2014 | Robl et al. | |
| 9,051,716 | B2 | 6/2015 | Bricker et al. | |
| 9,217,235 | B2 | 12/2015 | Robl et al. | |
| 9,222,235 | B2 * | 12/2015 | Frey | E02F 3/364 |
| 9,562,346 | B2 | 2/2017 | Jonsson et al. | |
| 9,834,904 | B2 | 12/2017 | Friedrich | |
| 9,863,117 | B2 | 1/2018 | Calvert et al. | |
| 10,156,055 | B2 | 12/2018 | Kovar et al. | |
| 10,190,283 | B2 * | 1/2019 | van Amelsfoort | E02F 3/3636 |
| 2010/0232920 | A1 * | 9/2010 | Calvert | E02F 3/3663 414/723 |
| 2015/0322646 | A1 * | 11/2015 | Anderson | E02F 3/3627 403/322.1 |
| 2016/0201290 | A1 | 7/2016 | O'Connor et al. | |
| 2016/0251820 | A1 | 9/2016 | Anthipagulu et al. | |
| 2016/0319508 | A1 | 11/2016 | Doherty et al. | |
| 2017/0121928 | A1 | 5/2017 | Robl et al. | |
| 2017/0321389 | A1 | 11/2017 | Kovar et al. | |
| 2018/0066418 | A1 * | 3/2018 | Keighley | E02F 3/3663 |

* cited by examiner

TOOL COUPLING ARRANGEMENT HAVING ZERO OFFSET

TECHNICAL FIELD

The present disclosure relates to a tool coupling arrangement and, more particularly, to a tool coupling arrangement having zero offset.

BACKGROUND

A tool coupler can be used to increase the functionality and versatility of a host machine by allowing different tools, such as buckets, to be quickly and interchangeably connected to the linkage of the machine (e.g., a stick of an excavator). A pin grabber coupler is a common type of tool coupler. A conventional pin grabber coupler generally includes a frame having a first end that connects to the linkage of the machine and a second end that includes hooks that engage corresponding pins of a tool to thereby connect the tool to the linkage.

The use of a conventional pin grabber coupler introduces an added distance (i.e., an offset) between the end of the linkage and the pins on the tool. This offset may add additional tip radius to the machine, which may reduce the overall breakout forces seen at the end of the tool. In addition, the use of a tool coupler also adds additional weight and cost to the tool coupling arrangement.

U.S. Pat. Publication No. 2017/0321389 to Kovar et al. (the '389 publication) describes a tool coupler assembly that includes a power linkage assembly having a first power link. The first power link may include a first end configured for pivotal connection to a tool, and a second, opposite end configured for pivotal connection to one end of a tool control actuator. The tool control actuator may be connected at an opposite end to a first end of a machine link of a machine, wherein operation of the tool control actuator pivots the tool about a tool pivot axis coaxial with a tool engagement interface at a second end of the machine link. A power linkage actuator may be pivotally connected at a first end for coaxial rotation with the tool engagement interface at the second end of the machine link, and at a second end for coaxial rotation with the first end of the first power link.

SUMMARY OF THE DISCLOSURE

One aspect of the present disclosure is directed to a tool coupler for coupling a tool to an end of a machine link. The tool coupler may include a coupler frame, a hook configured to receive a first pin of the tool and configured to attach to the end of the machine link such that the tool coupler is pivotal about an axis, a wedge slidingly received within the coupler frame, and an actuator connected to the wedge to move the wedge away from the hook to bias a second pin of the tool against the coupler frame. The tool coupler mounts the tool to the machine link such that the tool pivots about the axis.

Another aspect of the present disclosure is directed to a tool coupler assembly. The tool coupler assembly may include a tool coupler and a machine link having a distal end configured to receive the first pin of the tool. The tool coupler may include a hook configured to secure the first pin of the tool to the distal end of the machine link, the hook further configured to pivotally attach to the distal end of the machine link, a wedge slidingly received within the coupler frame, and an actuator connected to the wedge to move the wedge away from the first end of the machine link to bias the second pin of the tool against the coupler frame. The tool coupler and the tool are pivotal relative to the machine link about the same axis.

Yet another aspect of the present disclosure is directed to a method of coupling, with zero offset, a tool to a machine. The method may include pivotally attaching the tool coupler to a distal end of a machine link, securing a first pin of the tool to the distal end of the machine, and wedging a second pin of the tool against a frame of the tool coupler. Both the tool coupler and the tool may be pivotal relative to the machine link about the same axis.

Other features and aspects of this disclosure will be apparent from the following description and the accompanying drawings.

BRIEF DESCRIPTION OF THE DRAWINGS

Further features and advantages of the invention will become apparent from the description of embodiments using the accompanying drawings. In the drawings.

DETAILED DESCRIPTION

Figure 1:
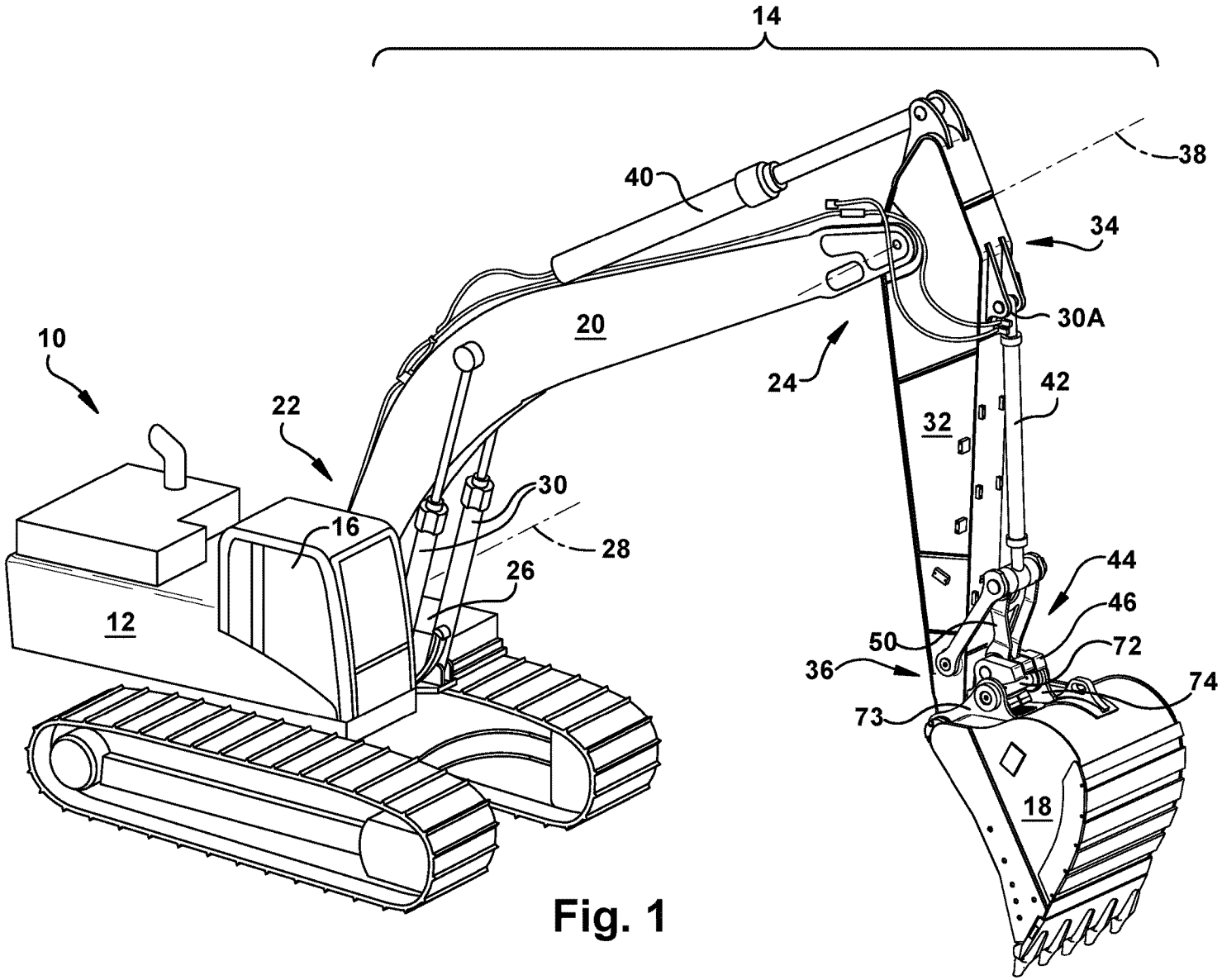
FIG. 1 is a pictorial illustration of an exemplary embodiment of a machine.

Referring to the drawings, FIG. 1 illustrates an exemplary embodiment of a machine 10. The term "machine" may refer to any machine, such as a fixed or mobile machine, that performs some type of operation associated with an industry such as mining, construction, farming, transportation, or any other industry known in the art. For example, the machine 10 may be an earth moving machine such as an excavator (shown in FIG. 1), a backhoe, a loader, material handler or any other earth moving machine. The machine 10 may include a power source 12, a linkage arrangement 14 driven by the power source 12, and an operator station 16 situated for control of the power source 12 and/or the linkage arrangement 14.

The power source 12 may embody an engine such as, for example, a diesel engine, a gasoline engine, a gaseous fuel-powered engine or any other type of combustion engine known in the art. It is contemplated that the power source 12 may alternatively embody a non-combustion source of power such as a fuel cell, a power storage device, or another source known in the art. The power source 12 may produce a mechanical or electrical power output that may then be converted to hydraulic pneumatic power for moving the linkage arrangement 14.

The linkage arrangement 14 may be acted on by actuators to move a tool 18. Any suitable actuators may be used, such as for example, hydraulic actuators, pneumatic actuators, electric actuators, electro-hydraulic actuators, electro-mechanical actuators, or other type of suitable actuator. The linkage arrangement 14 may be configured in a variety of ways. Any configuration of one or more movable links, arms, or the like, that the tool 18 can be mounted to for movement thereof may be used. The linkage arrangement 14 may be complex, for example, including three or more degrees of freedom. In the illustrated exemplary embodiment, the linkage arrangement 14 includes a first machine link 20, such as for example a boom of an excavator, having a first end 22 and a second end 24 opposite the first end 22. The first end 22 of the first machine link 20 is mounted to a frame 26 of the machine 10 to pivot about a horizontal axis 28 (as viewed in FIG. 1) by a pair of adjacent, double-acting, hydraulic cylinders 30. The linkage arrangement 14 may also include a second machine link 32, such as for example a stick of an excavator, having a first end 34 and a second or distal end 36. The first end 34 of the second machine link 32 is mounted to the second end 24 of the first machine link 20 to pivot about a horizontal axis 38 by a single, double-acting, hydraulic cylinder 40.

The linkage arrangement 14 may further include a single, double-acting, hydraulic cylinder 42 that is connected to a tool coupling assembly 44. Each of the hydraulic cylinders 30, 40, 42 may include a tube portion and a piston assembly arranged within the tube portion to form a head-end pressure chamber and a rod-end pressure chamber. The pressure chambers may be selectively supplied with pressurized fluid and drained of the pressurized fluid to cause the piston assembly to displace within the tube portion, thereby changing the effective length of hydraulic cylinders 30, 40, 42.

Figure 2:
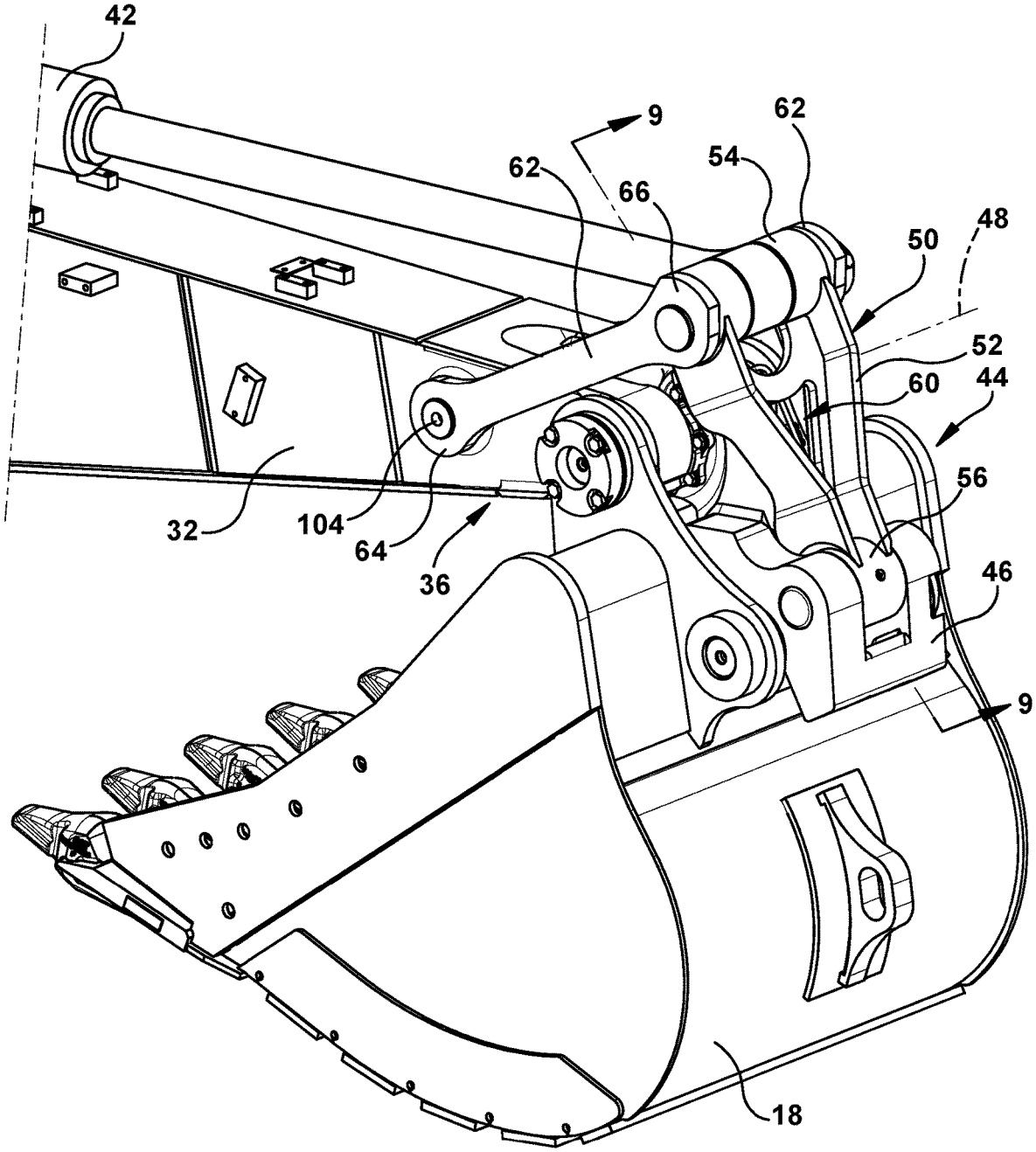
FIG. 2 is an illustration of a portion of the machine of FIG. 1, showing an enlarged view of an exemplary embodiment of a tool coupler assembly, including a tool coupler.

The tool coupling assembly 44 is provided to facilitate a quick connection between the linkage arrangement 14 and the tool 18. The tool coupling assembly 44 may include a tool coupler 46 and a portion of the linkage arrangement 14, such as for example, the second end 36 of the second machine link 32. In the exemplary embodiment of FIG. 1, the tool 18 is mounted to the second end 36 of the second machine link 32 to pivot about a horizontal axis 48 (FIG. 2). The hydraulic cylinder 42 may be connected at a head-end to a base portion of the second machine link 32 and to the tool 18 at an opposing rod-end by way of a first power link 50 and the tool coupler 46.

Referring to FIG. 2, the first power link 50 may be configured in a variety of ways. In the illustrated embodiment, the first power link 50 hays a generally Y-shaped body 52. The body 52 includes a first end 54 and a second end 56 opposite the first end 54. The first end 54 may be bifurcated to form a clevis-like, pivotal connection with the rod end of the hydraulic cylinder 42. The second end 56 is configured to pivotally connect to the tool coupler 46. The body 52 of the first power link 50 may also include a recess or aperture 60 adapted to prevent the undesired contact between the body 52 and portions of the tool coupler 46 during full range of motion of the tool 18.

The linkage arrangement 14 may further include a pair of second power links 62. Each of the second power links 62 include a first end 64 and a second end 66. The first end 64 the second power links 62 are pivotally attached to opposite sides of the second machine link 32. The second end 66 of each of the second power links 62 is pivotally attached to the first end 54 of the first power link 50. It should be noted that other configurations of the linkage arrangement 14 may also be possible.

The tool 18 may be configured in a variety of ways. Numerous different tools 18 may be attachable to a single machine 10 and controllable via the operator station 16. Each tool 18 may include a device used to perform a particular task such as, for example, a bucket, a fork arrangement, a blade, a grapple, or any other task-performing device. Although connected in the embodiment of FIG. 1 to pivot relative to machine 10, the tool 18 may additionally rotate, slide, swing, lift, or move in any other manner known in the art. The tool 18 may include a forward-located first tool pin 70 (FIG. 9) and a rearward-located second tool pin 72 that facilitate connection to the linkage arrangement 14. The tool pins 70, 72 may be joined at their ends by a pair of spaced apart tool brackets 73, 74 that are welded to an external surface of the tool 18.

Figure 3:
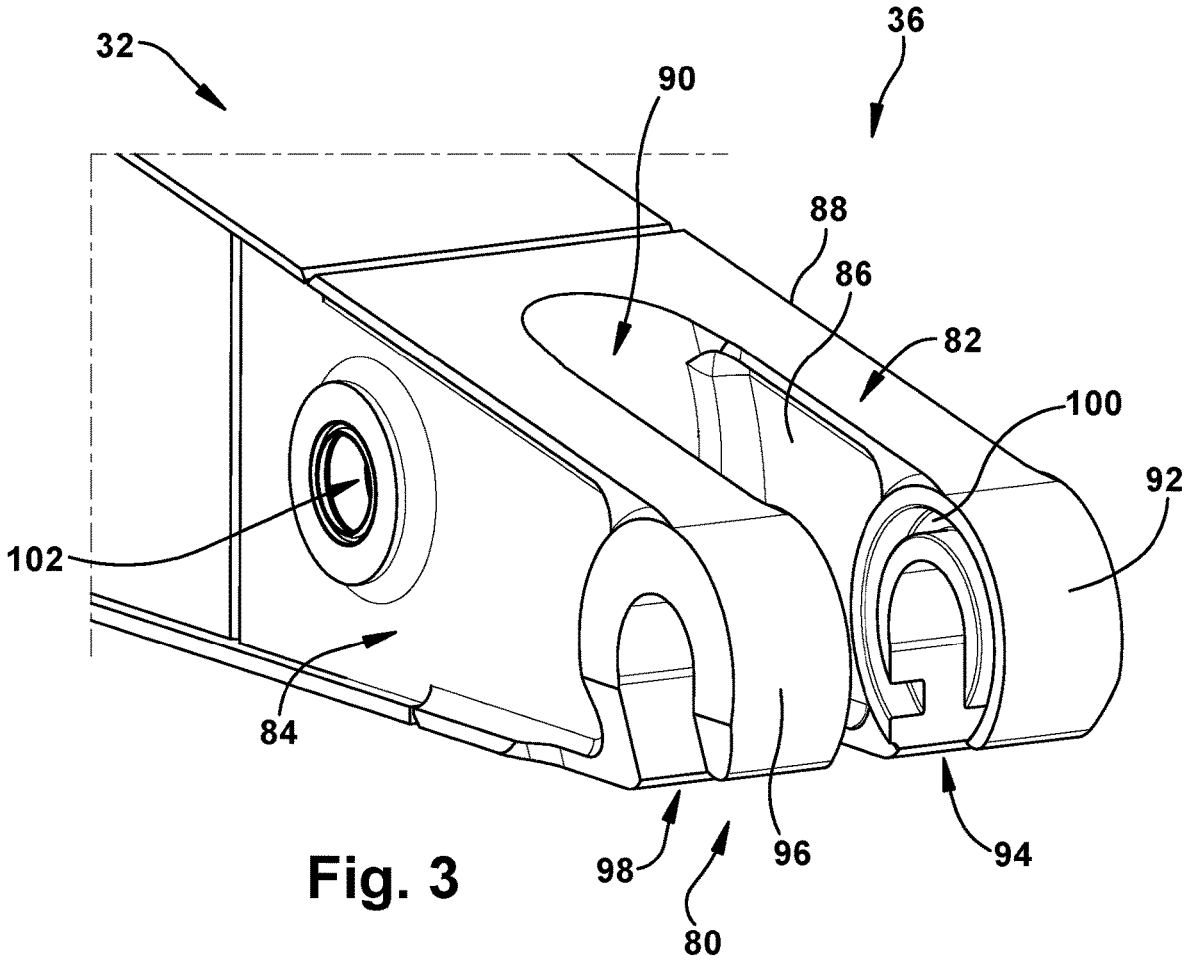
FIG. 3 is an illustration of a distal end portion of a machine link of the machine of FIG. 1.

Referring to FIG. 3, the second end 36 of the second machine link 32 includes a tool coupling interface 80 configured for coupling both the tool 18 and the tool coupler 46 to the second end 36. The tool coupling interface 80 may be configured in a variety of ways. Any configuration capable of pivotally coupling to the tool 18 and the tool coupler 46 to the second end 36 may be used. For example, the tool coupling interface 80 may include arcuate tongue or an arcuate groove configured for slidable engagement with one of a mating arcuate groove and arcuate tongue, respectively, on the tool coupler 46 to form a tongue and groove configuration. One of ordinary skill in the art will recognize that the tongue and groove configuration may be replaced with other alternative configurations that allow for coaxial rotation of the mating parts at the tool coupling interface, such as for example, ball bearings and a rolling engaged relationship.

In the illustrated embodiment, the second end 36 is bifurcated having a first leg 82 and a second leg 84 spaced apart from and extending parallel to the first leg 82. In the illustrated embodiment, the second leg 84 is identical to, but a mirror image of, the first leg 82, thus the description of the first leg 82 applies equally to the second leg 84. In other embodiments, however, the second leg 84 may be configured differently than the first leg 82.

The first leg 82 includes a first inner side surface 86 and a first outer side surface 88 generally parallel to and opposite the first inner side surface 86. The space between the first leg 82 and the second leg 84 forms a channel 90 configured to receive a portion of the tool coupler 46. The tool coupling interface 80 includes a first hook 92 defining a downward facing, U-shaped, first recess 94 configured to receive the first tool pin 70. The second leg 84 forms a second hook 96 defining a downward facing, U-shaped, second recess 98 also configured to receive the first tool pin 70. The first and second recesses 94, 98 are configured for coaxial engagement with the first tool pin 70. The first hook 92 and the second hook 96 may be fixedly connected to the second machine link 32. For the purposes of this disclosure the phrase fixedly connected may include bolted to, welded to, integrally formed with or otherwise rigidly adjoined to.

The first inner side surface 86 includes a generally C-shaped or arcuate first groove 100 extending around the first recess 94. The first groove 100 is open ended such that both ends of the first groove 100 open into the first recess 94. A second groove 101 (FIG. 8), identical but a mirror image of the first groove 100, extends around the second recess 98 of the second leg 84. In other embodiments, however, the second groove 101 may not be identical to the first groove 100. The second machine link 32 may also include a cross bore 102 for receiving one or more pins 104 (FIG. 2) to pivotally mount the first ends 64 of the second power links 62 to the second machine link 32.

Figure 4:
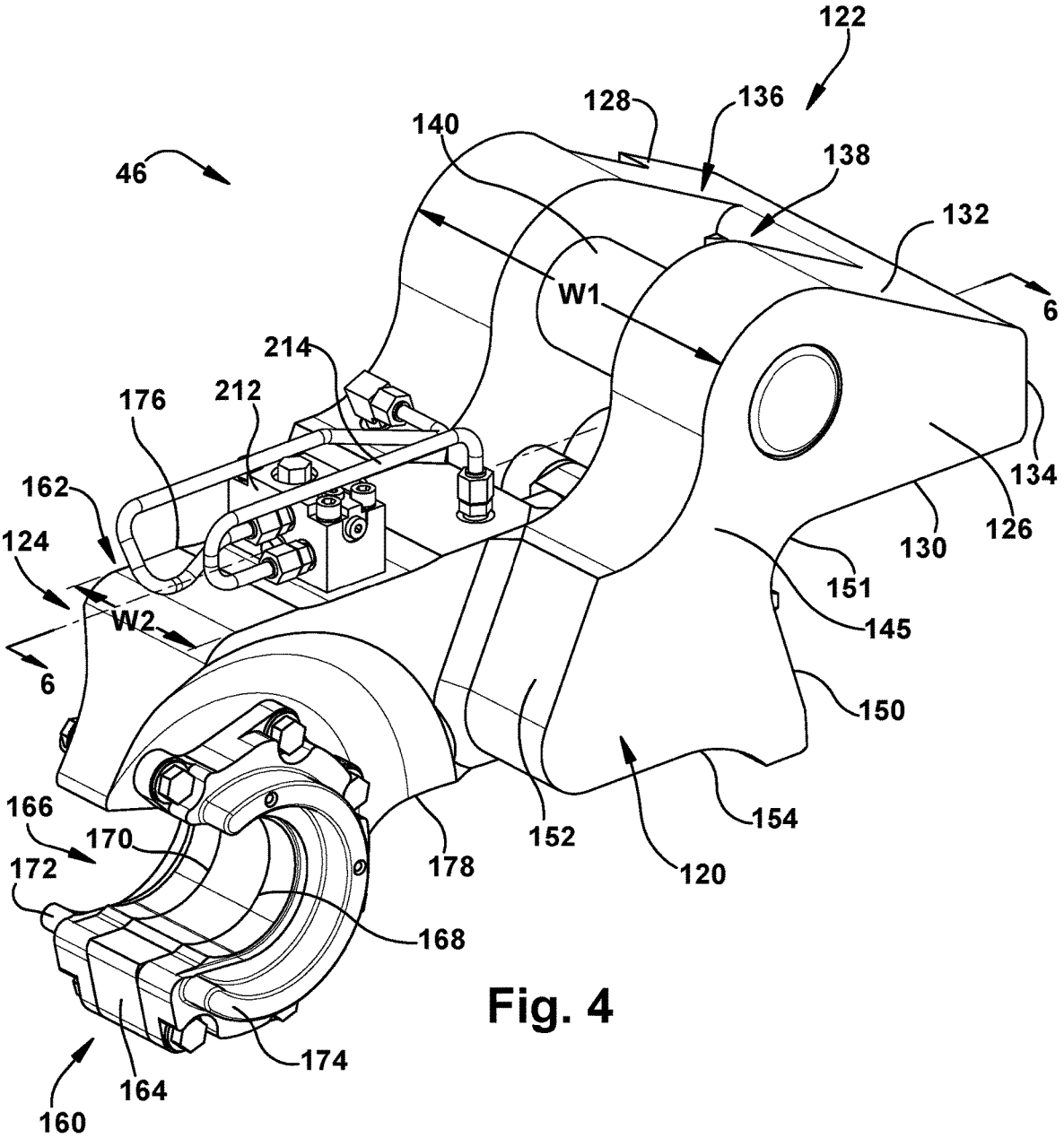
FIG. 4 is a first perspective view of the tool coupler of FIG. 2.
Figure 5:
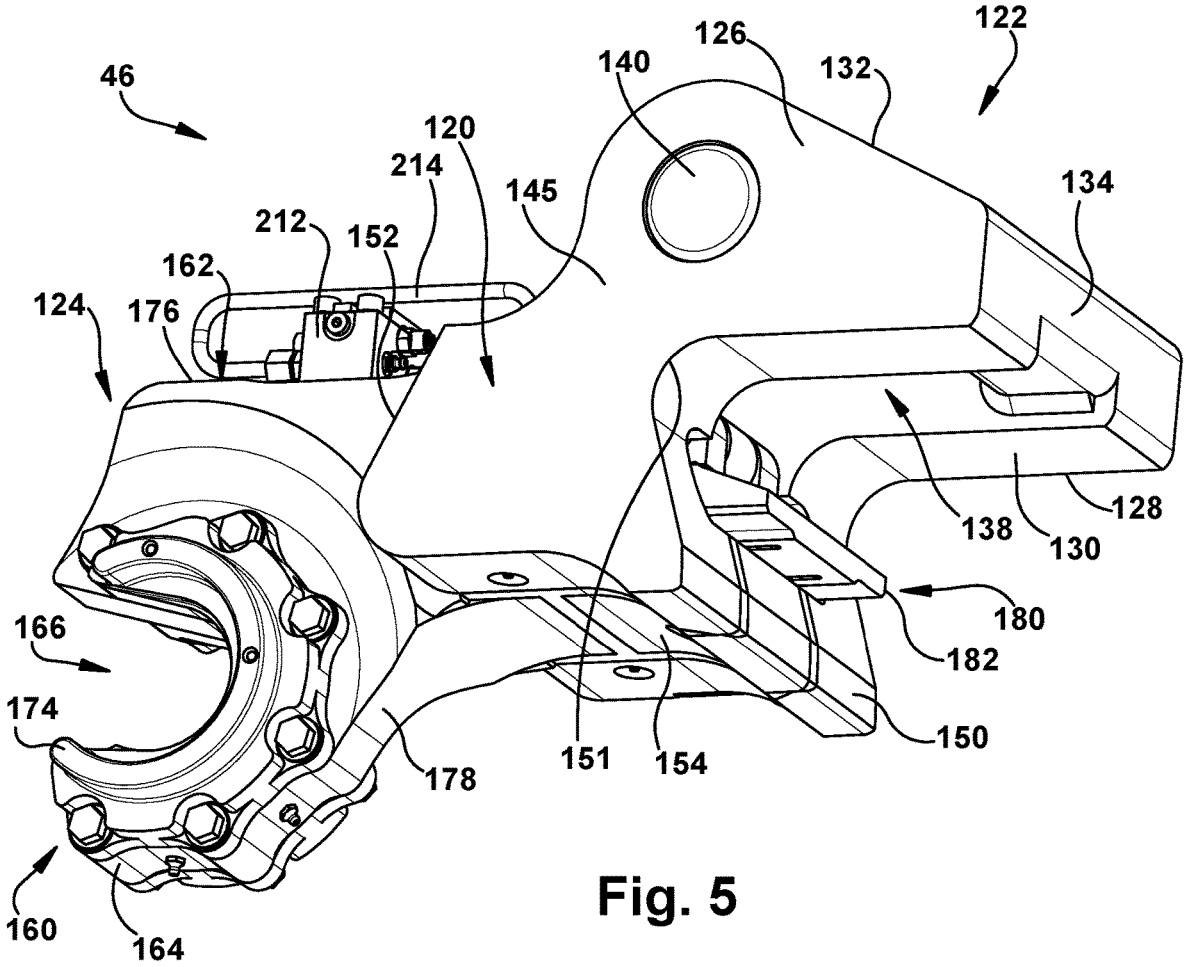
FIG. 5 is a second perspective view of the tool coupler of FIG. 2.
Figure 6:
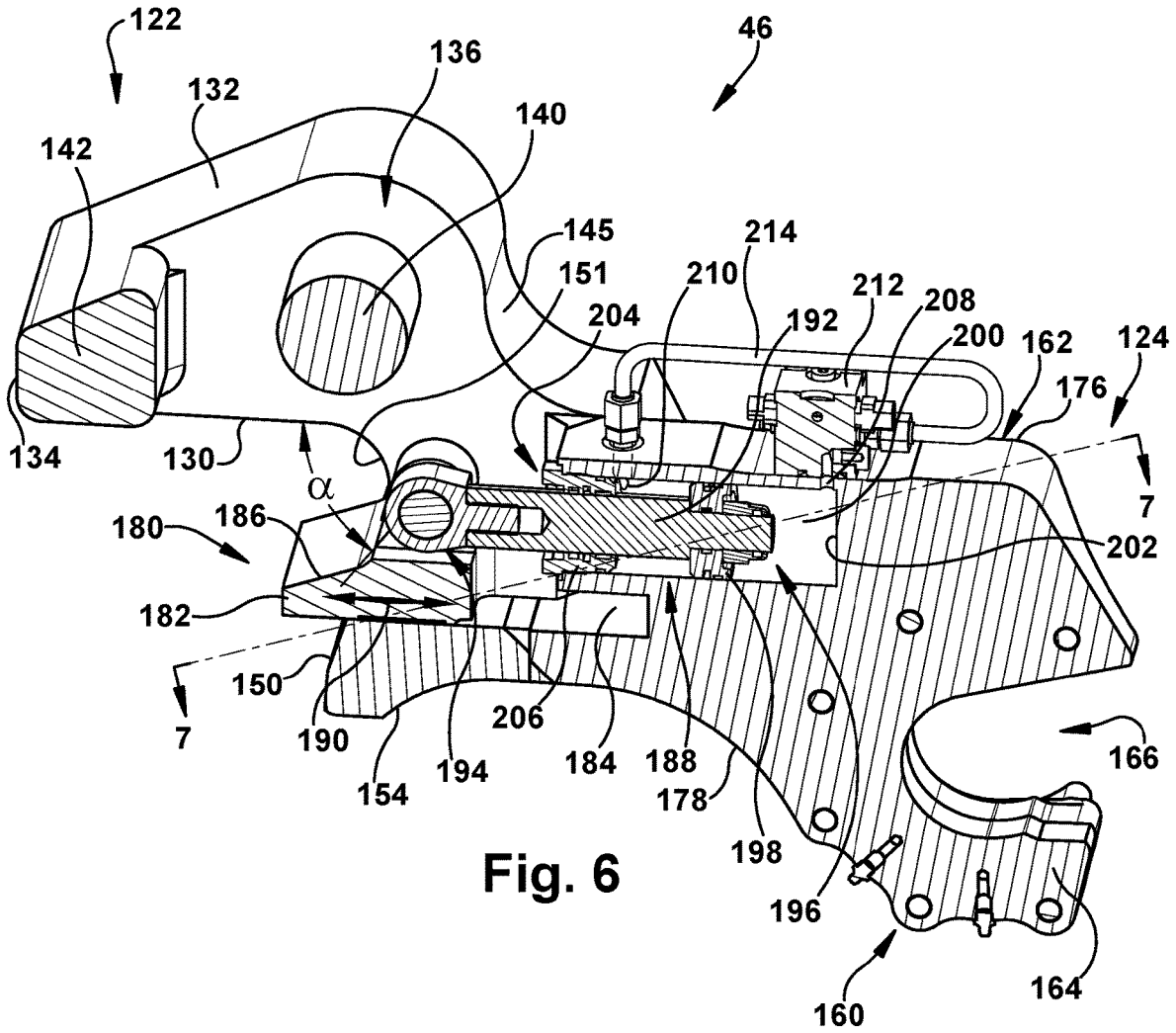
FIG. 6 is sectional view of the tool coupler of FIG. 2 along the 6-6 line and shown in a coupling state.

The tool coupler 46 is configured to engage the tool pins 70, 72 to attach the tool 18 to the second machine link 32. The tool coupler 46 may be configured in a variety of ways. Referring to FIGS. 4-6, in the illustrated embodiment, the tool coupler 46 includes a frame 120 having a forward portion 122 and a rearward portion 124. The frame 120 includes a first side surface 126 and a second side surface 128 opposite and generally parallel to the first side surface 126. The forward portion 122 includes a generally planar bottom surface 130, a generally planar top surface 132 that extends at an angle relative to the bottom surface 130, and a forward surface 134 extending between the top surface 132 and the bottom surface 130.

In the illustrated embodiment, the forward portion 122 defines a power link interface 136. The power link interface 136 may be configured in a variety of ways. Any interface that allows the tool coupler 46 to be pivotally mounted to the first power link 50 may be used. In the illustrated embodiment, the power link interface 136 includes a channel 138 extending through the frame 120 from the top surface 132 to the bottom surface 130 and a cross pin 140 that extends across the channel 138. The second end 56 of the first power link 50 is adapted to pivotally mount to the cross pin 140. A bridge portion 142 (FIG. 6) extends across a front end of the forward portion 122.

The forward portion 122 of the tool coupler 46 includes a neck portion 145 that attached the forward portion 122 to the rearward portion 124. The rearward portion 124 of the tool coupler 46 includes a front surface 150 extending at an angle $\alpha$ to the bottom surface 130 of the forward portion 122 to form a corner or notch 151 therebetween. The front surface 150 has a first width W1. The rearward portion 124 includes a rear surface 152 opposite the front surface 150 and a bottom surface 154 extending between the front surface 150 and the rear surface 152. The bottom surface 154 may be curved or contoured to be complementary of a profile of the tool 18. For example, in the illustrated embodiment, the bottom surface 154 is curved to be complementary to the top plate 156 (FIG. 9) of the illustrated bucket.

In the illustrated embodiment, the rearward portion 124 defines a tool support interface 160. The tool support interface 160 may be configured in a variety of ways. Any configuration that allows the tool coupler 46 to be pivotally coupled to the tool coupling interface 80 of the second machine link 32 and facilitates retaining the tool 18 onto the second machine link 32 may be used. In the illustrated embodiment, the tool support interface 160 is positioned on a projection 162 that extends rearward from the rear surface 152. The projection 162 has a second width W2, which is smaller than the first width W1.

The tool support interface 160 includes a hook 164 defining a rearward facing, U-shaped recess 166. The hook 164 may be fixedly connected to the frame 120. For the purposes of this disclosure the phrase fixedly connected may include bolted to, welded to, integrally formed with or otherwise rigidly adjoined to. The recess 166 is configured to receive the first tool pin 70 and retain the first tool pin 70 in the first recess 94 and the second recess 98 on the second machine link 32. The hook 164 includes a first side surface 168 and a second side surface 170 opposite the first side surface 168. The first side surface 168 includes a first C-shaped, or arcuate ridge or tongue 172 configured to be received in the first groove 100 on the first hook 92 of the tool coupling interface 80. The second side surface 170 includes a second C-shaped, or arcuate ridge or tongue 174 configured to be received in the second groove 101 on the second hook 96 of the tool coupling interface 80. Thus, the tool support interface 160 on the tool coupler 46 and the tool coupling interface 80 on the second end 36 of the second machine link 32 form a tongue and groove arrangement. As discussed above, alternatively, the first and second ridge 172, 174 may be formed on the second end 36 of the second machine link 32 and mating grooves may be formed on the tool coupler 46.

In the illustrated embodiment, the first ridge 172 and the second ridge 174 are each formed on bolt-on components that are attached to the first side surface 168 and a second side surface 170, respectively. In other embodiments, however, the first ridge 172 and the second ridge 174 may be formed integrally with the hook 164 or attached to the hook 164 in some other manner.

The projection 162 includes a top surface 176 and a bottom surface 178 opposite the top surface 176. The bottom surface 154 and/or the bottom surface 178 may be curved or contoured to be complementary of a profile of the tool 18. For example, in the illustrated embodiment, the bottom surface 178 is curved to be complementary to the top plate 156 of the illustrated bucket. In the illustrated embodiment, the bottom surface 154 forms a continuous surface with the bottom surface 178. In other embodiments, however, the bottom surface 154 and the bottom surface 178 may not form a continuous surface.

Figure 7:
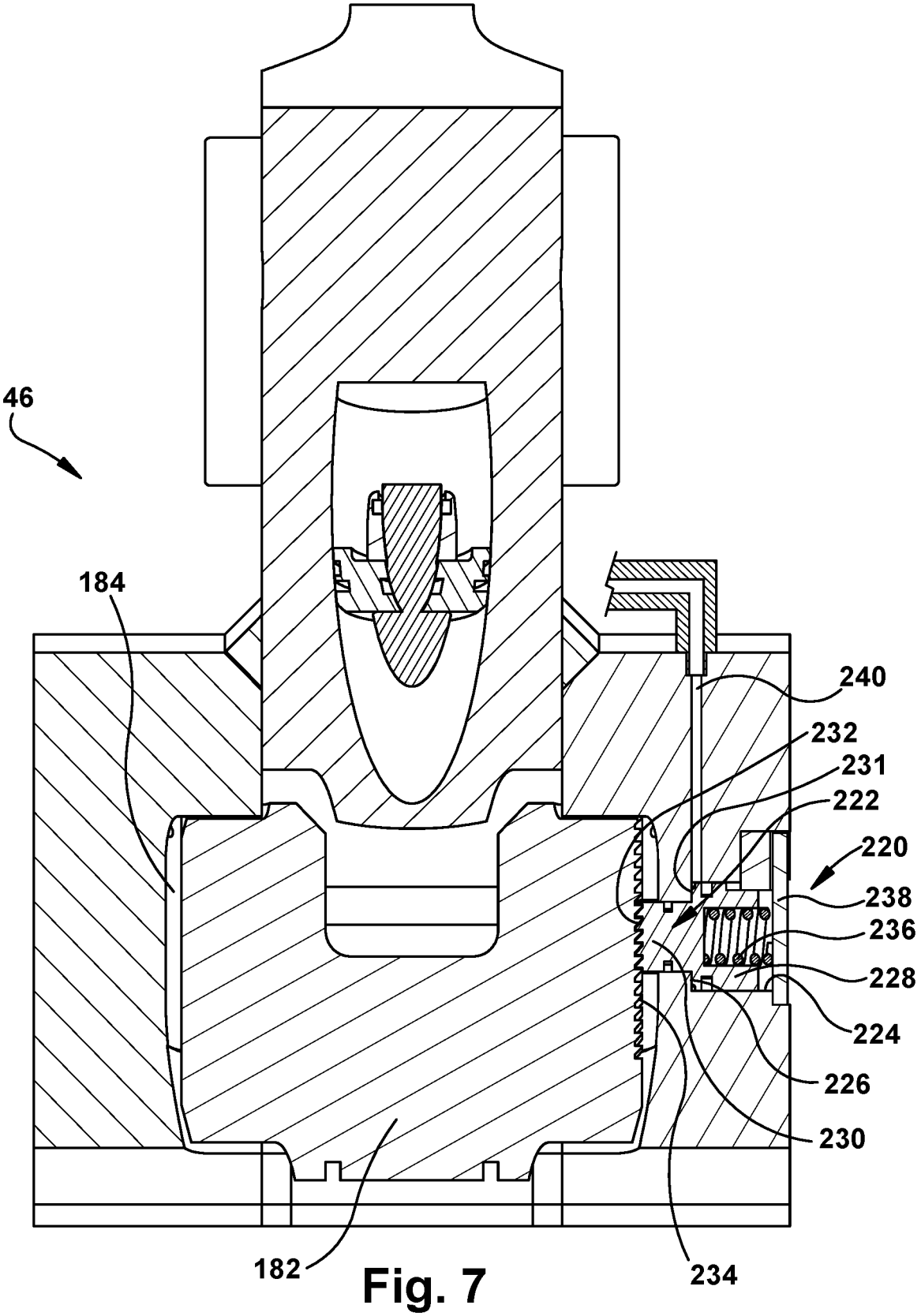
FIG. 7 is sectional view of the tool coupler of FIG. 2 along the 7-7 line and shown in an uncoupling state.

As shown in FIGS. 6-7, the rearward portion 124 of the tool coupler 46 also includes a tool locking system 180. The tool locking system 180 may be configured in a variety of ways. Any system that secures the tool 18 to the tool coupler 46 may be used. For example, the tool locking system 180 may be configured to bias the first and/or second tool pins 70, 72 against portions of tool coupler 46. The tool locking system 180 may include any number of interconnected and movable components.

In the illustrated embodiment, the tool locking system 180 may include tool pin interface 182 that is slidingly disposed within a channel 184 in the rearward portion 124. The channel 184 is open at the front surface 150. The tool pin interface 182 may be configured in a variety of way. In the illustrated embodiment, the tool pin interface 182 is a wedge having an upward-facing, inclined surface 186.

The tool locking system 180 may also include an actuator 188 configured to move tool pin interface 182 in a direction represented by an arrow 190. The actuator 188 may be configured in a variety of ways. Any type of actuator that can be operated to change in length so as to exert a force at each end and move the tool pin interface 182 to bias the first and/or second tool pins 70, 72 against portions of tool coupler 46 may be used. Suitable actuators may include a hydraulic actuator, a pneumatic actuator, an electric actuator, electro-hydraulic actuator, electro-mechanical actuator, a manual screw actuator, or other type of suitable actuator. In the illustrated embodiment, the actuator 188 is a hydraulic actuator including a rod 192 having a first end 194 pivotally attached to the tool pin interface 182 and a second end 196 opposite the first end 194. A piston 198 is fixably attached on the rod 192 at, or proximate, the second end 196. The rod 192 and piston 198 are slideably disposed within a cylinder 200. In the illustrated embodiment, the cylinder 200 is integrally formed within the frame 120 of the tool coupler 46. For example, the cylinder 200 may be machined into the frame 120 or cast as part of the frame 120. In other embodiments, however, the cylinder 200 may not be integrally formed in the frame 120.

The cylinder 200 has a closed first end 202 and an open second end 204 through which the rod 192 extends. A seal 206 is disposed at the second end 204 to retain working fluid within the cylinder 200. A first fluid port 208 is in fluid communication with the cylinder 200 between the piston 198 and the first end 202 and a second fluid port 210 is in fluid communication with the cylinder 200 between the piston 198 and the second end 204 to route working fluid into and out of the cylinder 200. In the illustrated embodiment, a hydraulic valve assembly 212 and hydraulic lines 214 are mounted to a top surface 176 to selectively provide working fluid to the cylinder 200 via the first and second fluid ports 208, 210.

The tool coupler 46 may also include a locking arrangement 220 for locking the tool pin interface 182 in place. The locking arrangement 220 may be configured in a variety of ways. Any configuration capable of locking the tool pin interface 182 in position, even if a loss of working fluid pressure occurs, may be used. For example, the locking arrangement 220 may be a mechanical lock arrangement that retains the tool pin interface 182 in an extended or locked position even if a loss of working fluid pressure occurs. The locking arrangement 220 may include an actuator to engage the tool pin interface 182 or move another portion of the locking arrangement into engagement with and/or out of engagement with the tool pin interface 182. The actuator may be a hydraulic actuator, a pneumatic actuator, an electric actuator, electro-hydraulic actuator, electro-mechanical actuator, a manual screw actuator, or other type of suitable actuator.

Referring to FIG. 7, in the illustrated embodiment, the locking arrangement 220 includes a plunger 222 moveably disposed in a bore 224. The bore 224 extends from the second side surface 128 to the channel 184. The bore 224 includes an outward facing shoulder 226 that forms a stop. The plunger 222 has a head portion 228, a stem portion 230 opposite the head portion 228, and an inward facing shoulder 231 extending between the head portion 228 and stem portion 230.

The stem portion 230 include an engagement surface 232 configured to engage the tool pin interface 182. In the illustrated embodiment, the engagement surface 232 includes a plurality of teeth, ridges, or other structure for engaging the tool pin interface 182 and preventing the tool pin interface 182 from retracting. The tool pin interface 182 includes a corresponding engagement surface 234 for engaging the engagement surface 232 of the plunger 222. The tool pin interface 182 may include a plurality of teeth, ridges, or other structure for engaging the plunger 222 such that the plunger 222 prevents the tool pin interface 182 from retracting. In the illustrated embodiment, the engagement surface 232 of the plunger 222 and the engagement surface 234 of the tool pin interface 182 form a ratchet allowing the tool pin interface 182 to extend but not retract when the engagement surfaces 232, 234 are engaged.

The locking arrangement 220 may be configured to bias the plunger 222 inward such that the engagement surface 232 of the plunger 222 is biased against the engagement surface 234 of the tool pin interface 182. In the illustrated embodiment, the locking arrangement 220 includes a biasing element 236, such as for example, a spring, a least partially received in a recess 238 formed in the head portion 228 of the plunger 222.

The locking arrangement 220 may also be configured to selectively disengage the engagement surface 232 of the plunger 222 from the engagement surface 234 of the tool pin interface 182. In the illustrated embodiment, the locking arrangement 220 includes a fluid passage 240 in fluid communication with the valve assembly 212. The fluid passage 240 is configured to direct working fluid between the inward facing shoulder 231 of the plunger 222 and the outward facing shoulder 226 of the bore 224 to move the plunger 222 outward against the bias of the biasing element 236. In the illustrated embodiment, the plunger 222 includes an annular recess 242 or chamfer located at the radial edge of the inward facing shoulder 231 to provide an initial area against which the working fluid can act.

INDUSTRIAL APPLICABILITY

The presently disclosed tool coupler 46 may be applicable to a variety of machines, such as excavators, backhoes, loaders, and motor graders, to increase the functionality of these machines. For example, a single excavator may be used for moving dirt, rock and other material, and during the excavation operations, different implements may be required such as a different size of bucket, an impact breaker, or a grapple. The disclosed tool coupler 46 can be used to quickly change from one implement to another with ease, thus reducing the time the machine is unavailable for its intended purpose.

Figure 8:
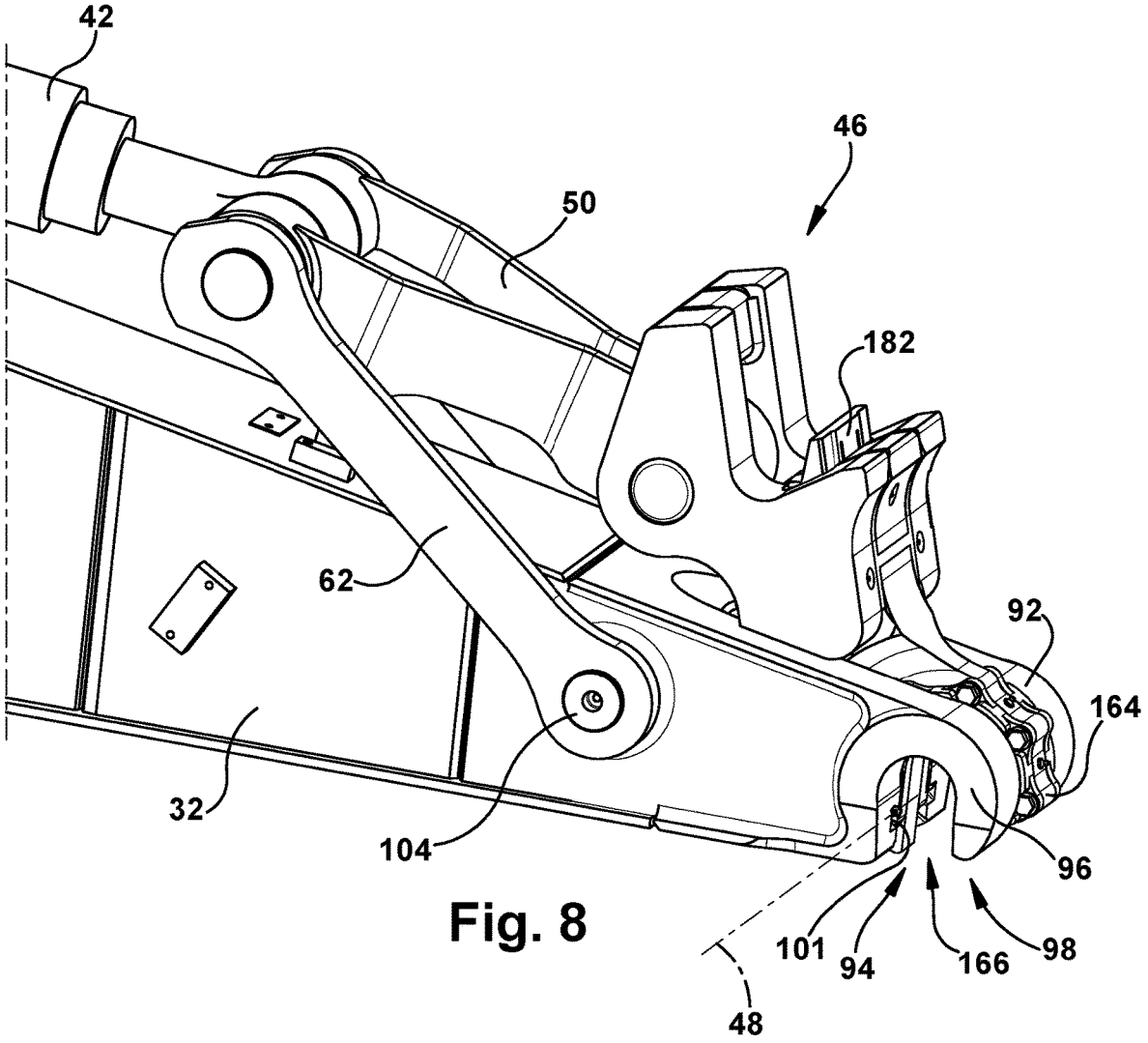
FIG. 8 is perspective view of the tool coupler assembly in a first position.

To attach the tool 18 to the second machine link 32, the tool coupler 46 is shown attached to the second machine link 32 and is placed in a first position in which the hydraulic cylinder 42 is in a retracted position, as shown in FIG. 8. In the first position, the tool coupler 46 is pivotally attached to the second machine link 32 via the first ridge 172 (FIG. 4) being received in the first groove 100 and the second ridge 174 (FIG. 4) being received in the second groove 101. In the first position, the opening of the recess 166 of the tool coupler 46 is aligned with the opening of first recess 94 and the opening of the second recess 98 in the second machine link 32. With the tool 18 resting on a surface, such as the ground, with the tool pins at the top, the aligned recesses 94, 98, 116 can be maneuvered onto the first tool pin 70 such that the first tool pin 70 is received in the recess 166 in the tool coupler 46 and both the first and second recess 94, 98 in the second machine link 32.

Figure 9:
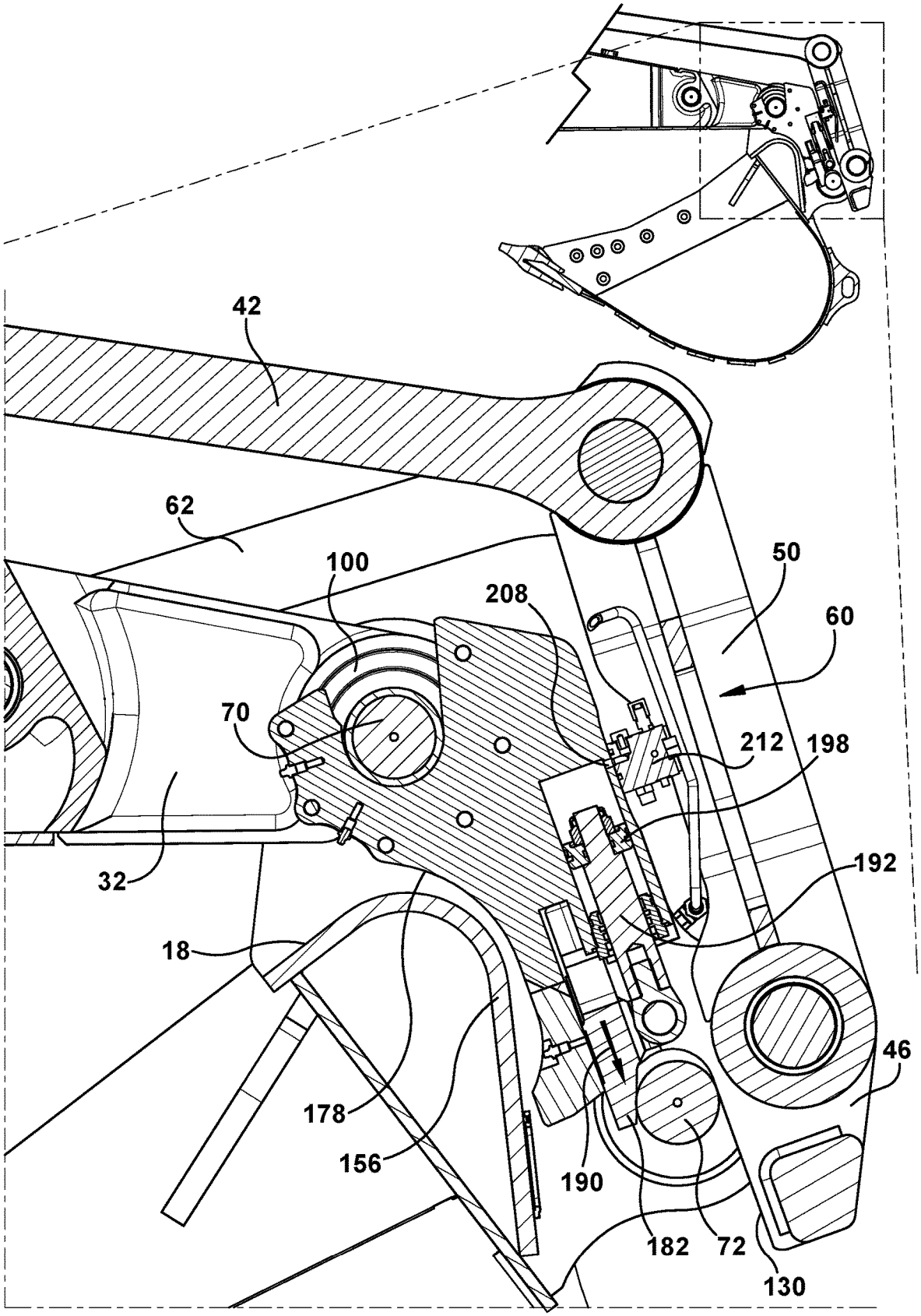
FIG. 9 is section view of the tool coupler assembly in a second position and attached to the tool.

Once the first tool pin 70 is received in the aligned recesses 94, 98, 166, the hydraulic cylinder 42 is moved to an extended position to pivot the tool coupler 46 (in a clockwise direction relative to the first position as shown in FIG. 8) to a second position, as shown in FIG. 9). In the second position, the tool coupler 46 is positioned such that the hook 164 on the tool coupler 46 moves into a position that captures the first tool pin 70 within the first and second recesses 94, 98 on the second machine link 32. In particular, the opening of the recess 166 on the tool coupler 46 is rotationally offset from the openings of the first and second recess 94, 98 on the second machine link 32 and the hook 164 blocks the first tool pin 70 from being withdrawn from the first and second recesses 94, 98.

In addition, in the second position, the second tool pin 72 is positioned at or near the corner 151 between bottom surface 130 and the front surface 150 on the tool coupler 46. As shown in FIG. 9, with the second tool pin 72 so positioned, the tool coupler 46 can secure the second tool pin 72 of the tool 18. In particular, the valve assembly 212 can route working fluid to the actuator 188 via the first fluid port 208 causing the rod 192 and piston 198 to extend the tool pin interface 182 in a direction away from the second end 36 of the second machine link 32 and the hook 164 to engage the second tool pin 72. As the actuator 188 extends, the tool pin interface 182 may be forced toward and under the second tool pin 72, thereby causing the inclined surface 186 of the tool pin interface 182 to engage the second tool pin 72. As the tool pin interface 182 is moved further away toward the second tool pin 72, the inclined surface 186 biases the second tool pin 72 against the bottom surface 130 of the tool coupler 46, thereby securing the second tool pin 72 to the tool coupler 46.

Unlike a conventional tool pin quick coupler, the tool coupler 46 does not introduce an "offset" at the end of the second machine link 32. As used in this application, "offset" refers to the shortest distance between a line drawn through both tool pins 70, 72 on the tool 18 and the point where the tool coupler 46 pivotally attaches to the second machine link 32. As described and illustrated above, the first tool pin 70 on the tool 18 is received in the recess 166 in the tool coupler 46 and both the first and second recess 94, 98 in the second machine link 32 such that the tool coupler 46 and the tool 18 are pivotal about the same horizontal axis 48. Thus, since the tool coupler 46 and the tool 18 are coaxially pivotally mounted to the second machine link 32, there is zero offset introduced by use of the tool coupler 46. Therefore, overall breakout forces are not reduced due to additional tip radius being added to the machine with the use of a quick coupler.

Further, as the tool pin interface 182 is moved toward the second tool pin 72, the ratcheting action of the locking arrangement 220 (FIG. 7) allows the tool pin interface 182 to extend away from the hook 164 but blocks the tool pin interface 182 from retracting toward the hook 164. As a result, the tool pin interface 182 will continue to secure the second tool pin 72 to the tool coupler 46 even in the event of loss of working fluid pressure to the actuator 188.

To disengage the locking arrangement 220, the valve assembly 212 can route working fluid to the actuator 188 via the second fluid port 210 causing the rod 192 and piston 198 to retract the tool pin interface 182 in a direction toward from the second end 36 of the second machine link 32 and the hook 164. Prior to, or concurrently, with routing working fluid to the second fluid port 210, the valve assembly 212 can route working fluid through the fluid passage 240 to move the plunger 222 out of engagement with the tool pin interface 182 to allow the rod 192 and piston 198 to retract the tool pin interface 182.

In addition, the configuration of the first power link 50 prevents undesired contact between the body 52 of the first power link 50 and the hydraulic valve assembly 212 and hydraulic lines 214 mounted to a top surface 176 of the tool coupler 46. In particular, in the second position of the tool coupler 46, the hydraulic valve assembly 212 and hydraulic lines 214 are received in the recess or aperture 60 in the body 52 and do not contact the body 52.

It will be apparent to those skilled in the art that various modifications and variations can be made to the tool coupler assembly of the present disclosure without departing from the scope of the disclosure. Other embodiments will be apparent to those skilled in the art from consideration of the specification and practice of the tool coupler assembly disclosed herein. For example, although the disclosed tool coupler is illustrated attaching to the second machine link via ridge and groove features, other features may be provided that also allow coaxial pivotal engagement between the second machine link and the tool and tool coupler. It is intended that the specification and examples be considered as exemplary only, with a true scope of the disclosure being indicated by the following claims and their equivalent.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

ELEMENT LIST

| Element Number | Element Name |
|---|---|
| 10 | machine |
| 12 | power source |
| 14 | linkage arrangement |
| 16 | operator station |
| 18 | tool |
| 20 | first machine link |
| 22 | first end |
| 24 | second end |
| 26 | frame |
| 28 | horizontal axis |
| 30 | hydraulic cylinders |
| 32 | second machine link |
| 34 | first end |
| 36 | distal end |
| 38 | horizontal axis |
| 40 | hydraulic cylinder |
| 42 | hydraulic cylinder |
| 44 | tool coupling assembly |
| 46 | tool coupler |
| 48 | horizontal axis |
| 50 | first power link |
| 52 | body |
| 54 | first end |
| 56 | second end |
| 60 | aperture |
| 62 | second power links |
| 64 | first end |
| 66 | second end |
| 70 | first tool pin |
| 72 | second tool pin |
| 73 | tool brackets |
| 74 | tool brackets |
| 80 | tool coupling interface |
| 82 | first leg |
| 84 | second leg |
| 86 | first inner side surface |
| 88 | first outer side surface |
| 90 | channel |
| 92 | first hook |
| 94 | first recess |
| 96 | second hook |
| 98 | second recess |
| 100 | arcuate first groove |
| 101 | second groove |
| 102 | cross bore |
| 104 | pins |
| 116 | aligned recesses |
| 120 | frame |
| 122 | forward portion |
| 124 | rearward portion |
| 126 | first side surface |
| 128 | second side surface |
| 130 | bottom surface |
| 132 | top surface |
| 134 | forward surface |
| 136 | power link interface |
| 138 | channel |
| 140 | cross pin |
| 142 | bridge portion |
| 145 | neck portion |
| 150 | front surface |
| 151 | notch |
| 152 | rear surface |
| 154 | bottom surface |
| 156 | top plate |
| 160 | tool support interface |
| 162 | projection |

-continued

| ELEMENT LIST | |
|---|---|
| Element Number | Element Name |
| 164 | hook |
| 166 | recess |
| 168 | first side surface |
| 170 | second side surface |
| 172 | tongue |
| 174 | tongue |
| 176 | top surface |
| 178 | bottom surface |
| 180 | tool locking system |
| 182 | tool pin interface |
| 184 | channel |
| 186 | inclined surface |
| 188 | actuator |
| 190 | arrow |
| 192 | rod |
| 194 | first end |
| 196 | second end |
| 198 | piston |
| 200 | cylinder |
| 202 | first end |
| 204 | second end |
| 206 | seal |
| 208 | first fluid port |
| 210 | second fluid port |
| 212 | hydraulic valve assembly |
| 214 | hydraulic lines |
| 220 | locking arrangement |
| 222 | plunger |
| 224 | bore |
| 226 | outward facing shoulder |
| 228 | head portion |
| 230 | stem portion |
| 231 | inward facing shoulder |
| 232 | engagement surface |
| 234 | engagement surface |
| 236 | biasing element |
| 238 | recess |
| 240 | fluid passage |
| 242 | annular recess |

What is claimed is:

1. A tool coupler for coupling a tool to an end of a machine link of a machine, the machine having a tool coupling assembly including the tool coupler, a first power link connected at a first end to a rod-end of a hydraulic cylinder and at a second end to the tool coupler, and a second power link connected at a first end to a distal end of the machine link and at a second end to the first end of the first power link, the tool having a first pin and a second pin, the tool coupler comprising:

a coupler frame;

a tool coupler hook configured to receive the first pin of the tool and configured to attach to a machine link hook at the distal end of the machine link such that the tool coupler is pivotal about an axis and the tool coupler hook, the machine link hook and the received first pin are coaxially aligned on the axis;

a wedge slidingly received within the coupler frame; and an actuator connected to the wedge to move the wedge away from the tool coupler hook to bias the second pin of the tool against the coupler frame, wherein the tool coupler mounts the tool to the machine link such that the tool pivots relative to the machine link about the first pin and the axis.

2. The tool coupler of claim 1, wherein the actuator is a fluid-driven actuator having a piston disposed within a cylinder, and wherein the cylinder is integrally formed within the coupler frame.

3. The tool coupler of claim 2, wherein the wedge is slideably received in a channel extending in a first direction and the cylinder extends in a second direction parallel to the first direction.

4. The tool coupler of claim 2, wherein the cylinder is machined into the coupler frame.

5. The tool coupler of claim 1, wherein the tool coupler hook includes a first side surface having one of a first ridge or a first groove that is configured to be received in a first groove or a first ridge, respectively, on the machine link hook.

6. The tool coupler of claim 5, wherein the first ridge and the first groove are both C-shaped.

7. The tool coupler of claim 5, wherein the first ridge is attached to the tool coupler hook or the machine link hook by one or more fasteners.

8. The tool coupler of claim 5, wherein the tool coupler hook includes one of a second ridge or a second groove that is configured to be received in a second groove or a second ridge, respectively, on the machine link hook.

9. The tool coupler of claim 1, further comprising a ratcheting locking arrangement that allows the actuator connected to the wedge to move the wedge away from the tool coupler hook but prevent the wedge from moving toward the tool coupler hook when the locking arrangement is engaged.

10. The tool coupler of claim 9, wherein the ratcheting locking arrangement includes a plurality of teeth configured to engage with a plurality of complementary teeth on the wedge.

11. A tool coupling assembly configured to couple a tool to a machine, the tool having a first pin and a second pin, the tool coupling assembly comprising:

a machine link having a machine link hook at a distal end configured to receive the first pin of the tool;

a first power link connected at a first end to a rod-end of a hydraulic cylinder on the machine link;

a second power link connected at a first end to the distal end of the machine link and at a second end to the first end of the first power link;

a tool coupler connected to a second end of the first power link, the tool coupler comprising:

a coupler frame;

a tool coupler hook configured to secure the first pin of the tool to the distal end of the machine link, the tool coupler hook further configured to pivotally attach to the machine link hook such that the tool coupler is pivotable about an axis and the tool coupler hook, the machine link hook and the first pin secured in the tool coupler hook are coaxially aligned on the axis;

a wedge slidingly received within the coupler frame; and an actuator connected to the wedge to move the wedge away from the first end of the machine link to bias the second pin of the tool against the coupler frame, wherein the tool coupler and the tool are pivotal relative to the machine link about the the first pin and the axis.

12. The tool coupling assembly of claim 11, wherein the machine link hook includes a first hook spaced apart from a second hook and wherein the tool coupler hook of the tool coupler is pivotally attached to both the first hook and the second hook.

13. The tool coupling assembly of claim 12, wherein the tool coupler hook includes a first side surface having one of a first ridge or a first groove that is configured to be received in a first groove or a first ridge, respectively, on the machine link hook.

14. The tool coupling assembly of claim 12, wherein the first ridge and first groove are both C-shaped.

15. The tool coupling assembly claim 13, wherein the first ridge is attached to the tool coupler hook or the machine link hook by one or more fasteners.

16. The tool coupling assembly claim 13, wherein the tool coupler hook includes one of a second ridge or a second groove that is configured to be received in one of a second groove or a second ridge, respectively, on the machine link hook.

17. The tool coupling assembly of claim 11, wherein the actuator is a fluid-driven actuator having a piston disposed within a cylinder, and wherein the cylinder is integrally formed within the coupler frame.

18. A method of coupling, with zero offset, a tool to a machine, the method comprising:

pivotally attaching a first end of a first power link to a rod-end of a hydraulic cylinder on a machine link;

pivotally attaching a first end of a second power link to a distal end of the machine link and a second end of the second power link to the first end of the first power link;

pivotally attaching a tool coupler hook of a tool coupler to a second end of the first power link and to a machine link hook at the distal end of the machine link such that the tool coupler is pivotal about an axis and the tool coupler hook and the machine link hook are coaxially aligned on the axis;

receiving a first pin of the tool in the tool coupler hook and the machine link hook such that the first pin is aligned on the axis;

wedging a second pin of the tool against a coupler frame of the tool coupler;

wherein both the tool coupler and the tool are pivotal relative to the machine link about the axis.

19. The method of claim 18, wherein pivotally attaching the tool coupler hook to the machine link hook further comprising receiving a ridge in a groove.

20. The method of claim 18, wherein wedging the second pin of the tool against the frame of the tool coupler further comprises actuating a hydraulic cylinder integrally formed within the frame of the tool coupler.

* * * * *